US005771501A

United States Patent [19]

Shaw

[11] Patent Number: 5,771,501

[45] Date of Patent: Jun. 30, 1998

[54] PLUMBING CONTROL SYSTEM AND METHOD FOR PRISONS

[75] Inventor: Daniel C. Shaw, Geneva, Fla.

[73] Assignee: Sloan Valve Company, Franklin Park, Ill.

[21] Appl. No.: 577,534

[22] Filed: Dec. 22, 1995

Related U.S. Application Data

[63] Continuation of Ser. No. 800,718, Dec. 3, 1991, abandoned, which is a continuation of Ser. No. 607,275, Oct. 31, 1990, abandoned, which is a division of Ser. No. 382,113, Jul. 20, 1989, Pat. No. 4,985,944.

[51] Int. Cl.[6] ..... E03D 3/00

[52] U.S. Cl. ..... 4/313; 4/DIG. 3

[58] Field of Search ..... 4/313, 623, 664, 4/665, DIG. 3, DIG. 15; 364/510

[56] References Cited

U.S. PATENT DOCUMENTS

| | | | |
|---|---|---|---|
| 2,860,348 | 11/1958 | McClenahan | 4/DIG. 15 |
| 3,987,502 | 10/1976 | Hartmann | 4/DIG. 15 |
| 4,030,145 | 6/1977 | Rowan | 4/DIG. 15 |
| 4,041,557 | 8/1977 | Ringler | 4/DIG. 15 |
| 4,195,374 | 4/1980 | Morris et al. | 4/DIG. 15 |
| 4,203,173 | 5/1980 | Morris et al. | 4/DIG. 15 |
| 4,471,498 | 9/1984 | Robertshaw | 4/DIG. 3 |
| 4,538,307 | 9/1985 | Barnum et al. | 4/DIG. 15 |
| 4,716,605 | 1/1988 | Shepherd et al. | 4/623 X |
| 4,802,246 | 2/1989 | Laverty, Jr. | 4/DIG. 3 |

FOREIGN PATENT DOCUMENTS

| | | | |
|---|---|---|---|
| 2165271 | 4/1986 | United Kingdom | 4/DIG. 15 |

OTHER PUBLICATIONS

"Microprocessor Restroom Robot", Claude A. Wiatrowski, Computer Design, Apr. 1977, pp. 98–100.

*Primary Examiner*—Robert M. Fetsuga
*Attorney, Agent, or Firm*—Joseph W. Berenato, III

[57] ABSTRACT

A flushing control system for prisons and the like includes a fixture and a source of water. A solenoid operated valve is interposed between the fixture and the source for regulating the flow of water to the fixture. A capacitance sensor is operably associated with the fixture for requesting operation of the valve. A control mechanism is operably associated with the capacitance sensor and with the valve for causing operation of the valve to be delayed for a selected period after the sensor has been operated and for limiting the number of operations of said valve per unit time.

32 Claims, 3 Drawing Sheets

PLUMBING CONTROL SYSTEM AND METHOD FOR PRISONS

This is a continuation of Ser. No. 07/800,718, filed on Dec. 3, 1991 which was abandoned which is a continuation of co-pending application Ser. No. 07/607,275, filed on Oct. 31, 1990 now abandoned which is a division of application Ser. No. 07/382,113, filed Jul. 20, 1989 U.S. Pat. No. 4,985,944.

BACKGROUND OF THE INVENTION

Many penal institutions, such as prisons, jails and the like, experience inmate-caused plumbing disruptions. These disruptions may be localized, such as when an inmate breaks a particular plumbing fixture, and they also may be systematic. Systematic disruptions occur when the plumbing system for the entire facility is interrupted, such as by the drain or sewer being stopped. Not only are such disruptions expensive to repair, but they also present a sanitation problem.

Corrections officers working in a penal institution will sometimes conduct a search for contraband possessed by the inmates. Should the inmates learn of such an inspection, then it is common for the contraband to be flushed down the toilet. In that event, the corrections officers have no way of identifying which inmates possess the contraband or even that contraband was present, thereby preventing the appropriate corrective action from being taken.

Those skilled in the art appreciate that the cost of incarcerating inmates has been increasing at a substantial rate over the past several years. These cost increases have been due, to some extent, upon the need to build additional facilities, and also to the cost of maintaining existing facilities. Anything which will reduce the cost of building and/or operating a penal institution will be helpful.

The disclosed invention is a system and method for controlling the operation of water-consuming fixtures in a prison. Each fixture is caused to be operated by an inmate-operated sensor which transmits an electrical control signal to a remotely located central controller. The controller identifies the fixture requesting operation, determines whether the fixture is being abused through repeated operation, and causes the fixture to be operated only after a predetermined delay. Means are also provided in the control system for preventing operation of all fixtures, for notifying corrections officers of potential vandalism at a fixture, and also for preventing excess water from flowing to sinks and the like. Means are also provided for preventing excessive simultaneous operation of a selected number of fixtures, thereby making maximum usage of the available water supply.

OBJECTS AND SUMMARY OF THE INVENTION

The primary object of the disclosed invention is a plumbing control system for a prison which delays operation of a water-consuming fixture for a period of time sufficient to prevent sheets and the like from being flushed down the drain, and which also prevents excessive use.

An additional object of the disclosed invention is to provide a method which prevents excessive usage of a water-consuming fixture, and which also delays operation for a predetermined period sufficient to prevent sheets and the like from being flushed.

A flushing control system for prisons and the like comprises a fixture and a source of water. Means are interposed between the fixture and the source for regulating the flow of water to the fixture. Means are operably associated with the fixture for requesting operation of the regulating means, and control means are operably associated with the regulating means and with the requesting means for causing operation of the regulating means to be delayed for a selected period after the requesting means has been operated and for limiting the number of operations of the regulating means per unit time.

A control system for a prison plumbing system comprises a plurality of spaced fixtures and a source of water. A first plurality of flow regulating means are provided, and each of the flow regulating means is interposed between one of the fixtures and the source. A first plurality of capacitance sensors are provided, and each sensor is positioned proximate one of the fixtures and is operable to request operation of the associated fixture. Control means are operably associated with each of the flow regulating means and with the capacitance sensors for causing operation of a flow regulating means upon the expiration of at least a predetermined period subsequent to operation of the associated sensor, and for limiting the number of operations of each flow regulating means per unit time.

The method of controlling operation of prison fixtures and the like comprises the steps of signaling to a control means a request for operation of a prison fixture. Operation of the fixture is prevented if the operation thereof would exceed a predetermined number of operations per unit time, and operation of the fixture is delayed for a predetermined period if operation thereof would not exceed the predetermined number of operations per unit time. The fixture is operated after the predetermined period has expired.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DETAILED DESCRIPTION OF THE INVENTION

Figure 1:
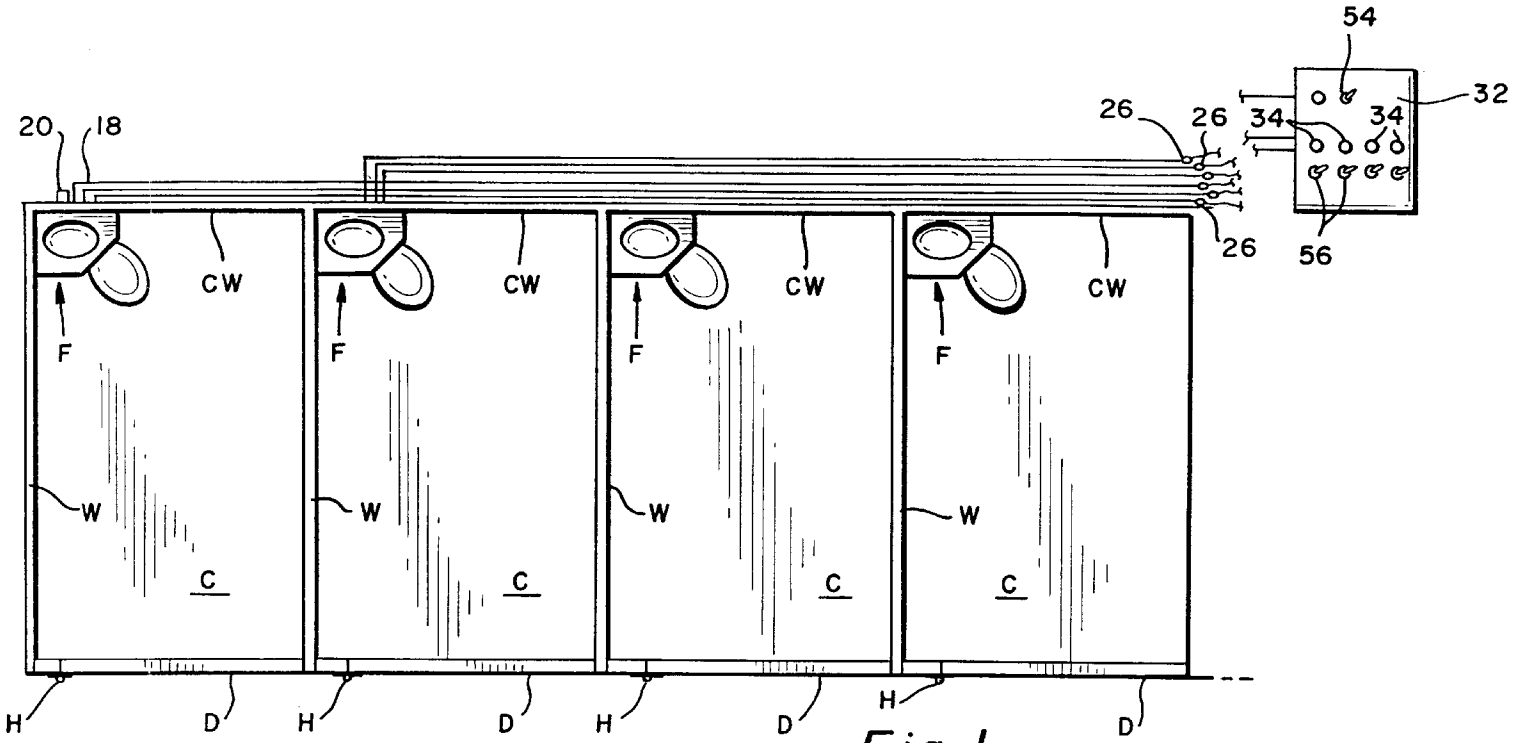
FIG. 1 is a fragmentary top plan view, partially in schematic, illustrating a prison wing incorporating the control system of the invention.

FIG. 1 discloses a plurality of spaced jail cells C, with each cell C having a door D closing one end thereof and being pivotal about hinge assembly H. Chase wall CW closes the end of each cell C opposite to door D, and walls W separate the cells from each other. While four cells C are disclosed in FIG. 1, those skilled in the art will appreciate that a greater or fewer number may be provided, depending upon the particular penal institution.

Figure 3:
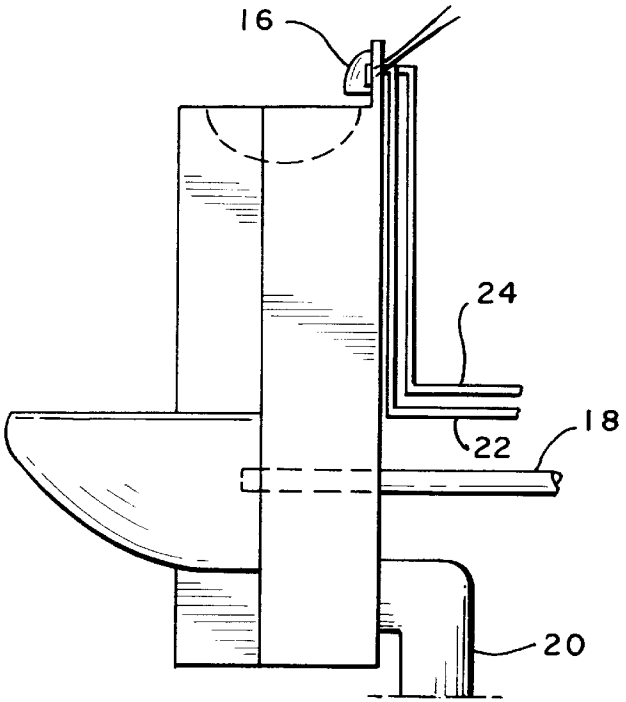
FIG. 3 is a side elevational view of the fixture of FIG. 2.
Figure 2:
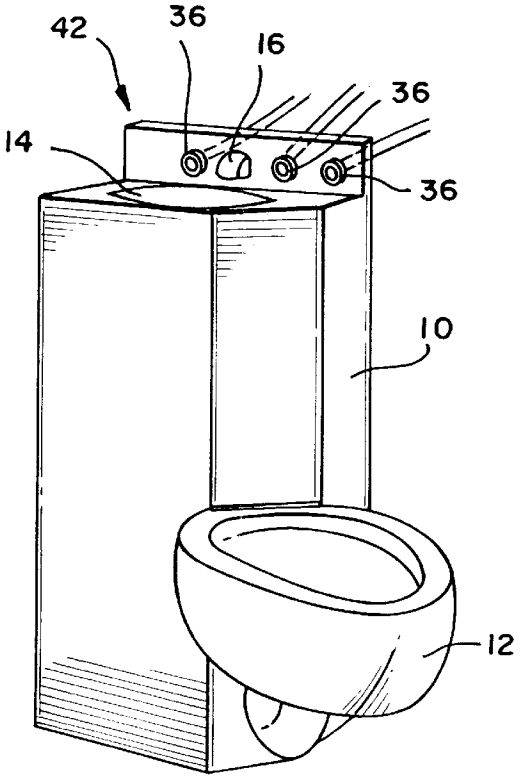
FIG. 2 is a perspective view of a prison fixture according to the invention.

Each cell C, as best shown in FIG. 1, has a water-consuming fixture F in one corner thereof. The fixtures F, as best shown in FIGS. 2 and 3, each include a cabinet 10 to which a toilet 12 is attached. The cabinet 10 also includes an integral sink 14 with a faucet 16. The fixture F is, preferably, comprised of stainless steel and may be located anywhere within the associated cell C.

Toilet 12, as best shown in FIG. 3, has a flushing water supply line 18 and a drain line 20. The toilet is conventional in design, and causes waste to be removed from the bowl to a treatment plant.

Cold water line 22 and hot water line 24 each feed faucet 16 issuing into sink 14. Preferably, a T-fitting of conventional type provides a mixing chamber for the hot and cold water lines 22 and 24, prior to feeding the faucet 16. In this way, the temperature of the water filling the sink 14 may be regulated. Also, while not illustrated, it will be understood by those skilled in the art that a drain leads from the sink 14 to a sewer as is conventional.

Figure 5:
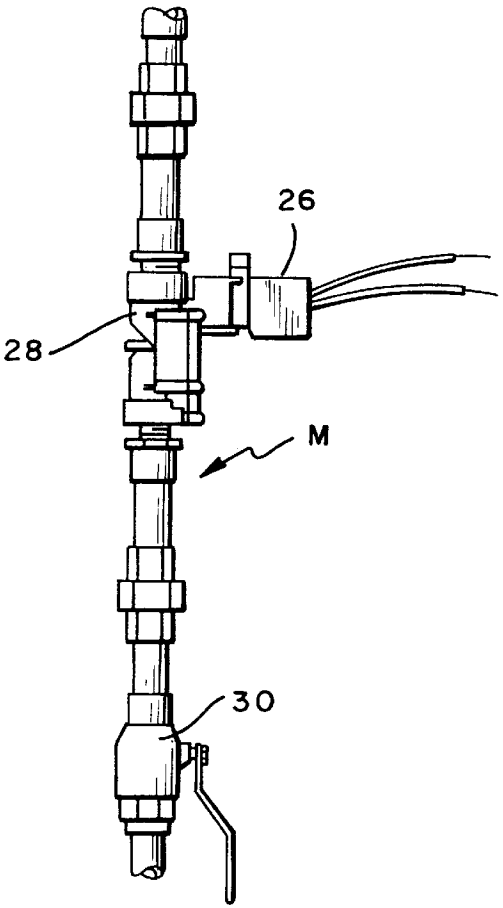
FIG. 5 is a fragmentary side elevational view of the flow regulating manifold of the invention; and, FIG. 6 is a flow diagram illustrating the operation of the invention.

FIG. 5 discloses water supply manifold M having electrically operated solenoid valve operator 26 controlling flow regulating valve 28. The valve 28 is, preferably, a normally closed valve, so that failure of the electric current to the valve operator 26 will prevent water from issuing through the valve 28. A manual shut-off valve 30 is downstream of flow valve 28, in order to permit the valve 28 to be changed or serviced as necessary. Naturally, appropriate plumbing interconnects the valve 30 with the valve 28, and also leads from the valve 28 to the toilet 12 or the faucet 16.

Inmates have a tendency to vandalize or destroy anything placed within their respective cell C. This includes, for example, any exposed plumbing or the like. For this reason, I position the solenoid valve operator 26 and control valve 28 at a location remote from the fixture F, preferably in a maintenance room, in order to minimize damage. Also, because of the control valve 28, I can utilize a relatively small water line, or even tubing. I provide a manifold M, comprising a solenoid operator 26 and flow valve 28, for each of the lines 18, 22 and 24 for each of the fixtures F. In this way, water can be selectively supplied to the lines 18, 22 and 24 of each cell C, while water flow to any or all of the other cells C is prevented.

The solenoid operators 26 are, as those skilled in the art will appreciate, electrically operated in response to a control signal. The valve 28 is normally closed, with the result that the control signal is used to open the valve. I provide a control panel 32, as best shown in FIG. 1, which is remote from the cells C. Preferably, control panel 32 is relatively close to, and may be in the same maintenance room as, the control valves 28 and operators 26. This minimizes difficulties in wiring the control panel 32 to the operators 26, and also facilitates subsequent servicing. The control panel 32 has a plurality of indicator lamps 34, for reasons to be explained.

I provide capacitance sensors 36 on the fixture F for requesting operation of the various control valves 28. Capacitance sensors are preferred over conventional push buttons, because there are no moving parts which could be damaged by an inmate. Also, because only a control signal needs to be transmitted to the control panel 32, a capacitance sensor is sufficient to provide that signal. A capacitance sensor is one which consists of two conductors, such as parallel stainless steel plates, which are insulated from each other by a dielectric, for introducing capacitance into a circuit. This causes the electrical energy to be stored, blocks the flow of direct current, and permits the flow of alternating current to a degree dependent upon the capacitator's capacitance and the current frequency. Therefore, it is only necessary for the inmate to touch an exposed metal plate for the capacitance to be altered, and this causes a control signal to be transmitted to the control panel 32.

Figure 4:
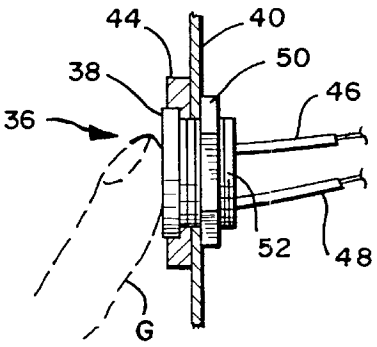
FIG. 4 is a fragmentary elevational view, partially in section, disclosing the capacitance sensor of the invention.

Each of the capacitance sensors 36, as best shown in FIG. 4, comprises an outer stainless steel plate 38 which is isolated by dielectric 44 from the stainless steel plate 40 integral with the splash guard 42 of fixture F. Leads 46 and 48 run from each sensor 36 to the control panel 32, in order to transmit the control signal thereto. Preferably, a lock washer 50 secures the longitudinally extending threaded plastic member 52 to the plate 40 for maintaining proper positioning of the plate 38. As a result, it is merely necessary that a finger G of an inmate (not shown) touch the plate 38, in order for a control signal to be transmitted to the control panel 32.

Figure 6:
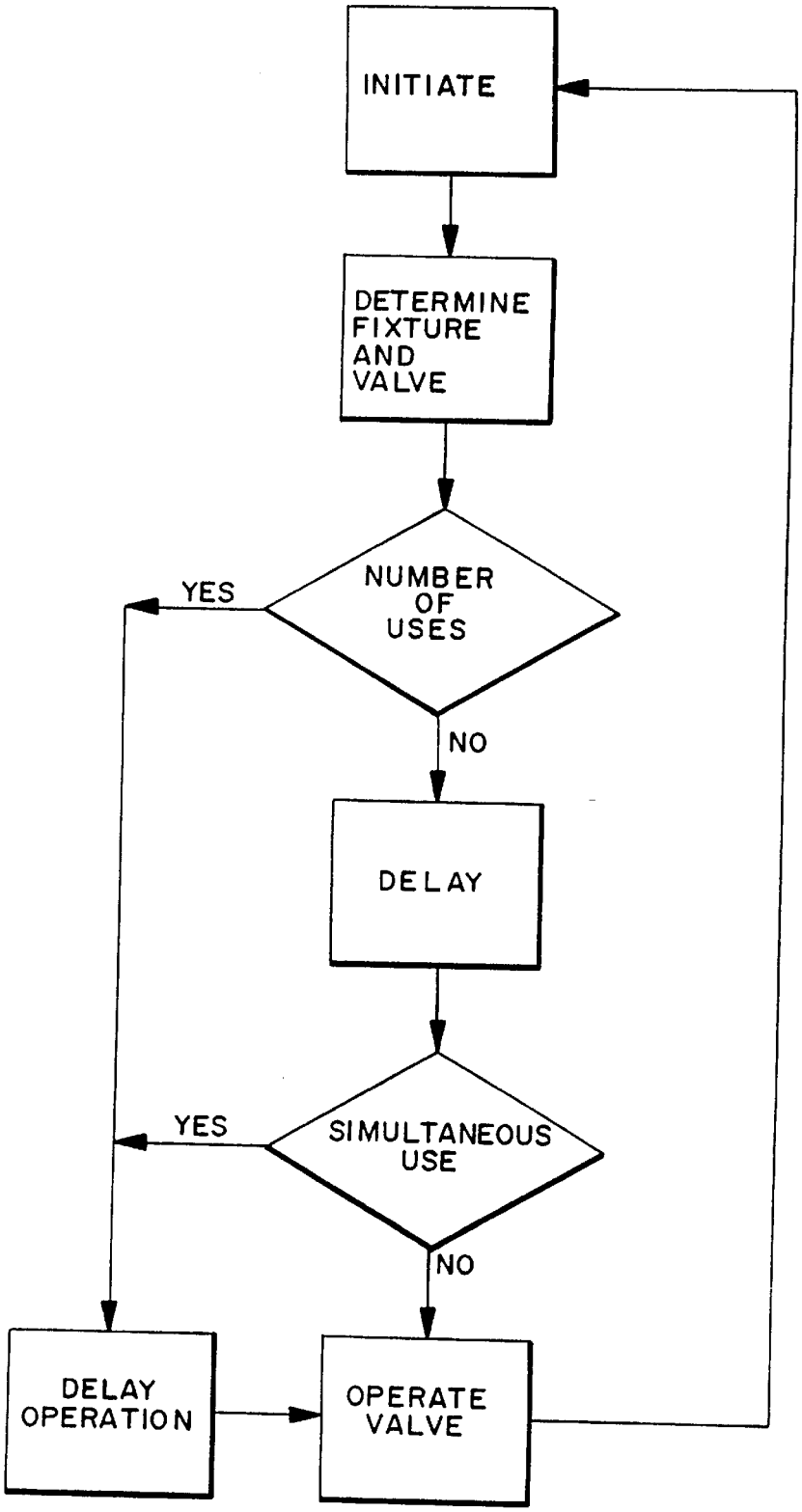

FIG. 6 discloses the algorithm by which the control system, which is preferably a microprocessor, contained within the control panel 32 determines whether to permit operation of a control valve 28 subsequent to receipt of a control signal from the associated sensor 36. The control panel 32 is initiated or made operable and, upon receipt of a control signal from any one of the sensors 36, determines which fixture F and which valve 28 thereof is requesting operation. The control system then determines whether operation of that valve 28 will exceed a predetermined number of uses per unit time. The predetermined number of uses per unit time prevents an inmate from rapidly and continually flushing the toilet 12, thereby preventing sheets or the like from being flushed down the drain 20. Should the requested next use exceed the selected maximum number of uses per unit time, then operation of the valve 28 is prevented. It should be appreciated, however, that the maximum number of uses per unit time is primarily directed to operation of the valves 28 for the toilets 12, because I prefer that the valves 28 for the hot and cold water line 22 and 24 be operable essentially at all times for sanitation reasons. Also, because a microprocessor is used to operate the algorithm, it is possible to adjust the maximum usage rate based upon time of day, and also between cells and cell blocks as desired.

Should operation of the associated valve 28 not exceed the maximum number of uses permitted per unit time, then the control system causes a delay of a predetermined length. This delay further assures that the inmate will not be able to flush sheets or the like down the drain 20. The delay period is based upon established sanitation criteria, and may provide substantial delays between cycles which has heretofore been impossible in conventional prison design. As with the maximum usage rate, because of the microprocessor control, the delay may be adjusted as required. A typical delay would be approximately two minutes between the time the sensor 36 transmits the control signal to the control panel 32 and initiation of operation of the associated valve 28.

Once the delay period has been achieved, then the control mechanism determines whether operation of the associated valve 28 would cause too many valves 28 to be operating simultaneously. I have learned that excessive simultaneous use of flush valves, such as the valves 28, can cause tremendous swings in the line pressure of the water line feeding the facility. My copending application, Ser. No. 212,405, filed Jun. 27, 1988, for the invention entitled FRESH WATER CONTROL SYSTEM AND METHOD, the disclosure of which is incorporated herein by reference, teaches a control system which prevents excessive simultaneous use of water-consuming fixtures. Control of simultaneous use permits smaller water lines to be used, smaller drain lines to be used, and further minimizes the operating and construction cost of the facility.

Assuming that operation of the valve 28 requesting operation will not exceed the permitted simultaneous usage factor, then that valve 28 is permitted to operate. Should operation of that valve 28, on the other hand, cause the system to exceed the available water supply, as noted in my copending application, then operation is delayed until sufficient water is available. As noted in my copending application, I prefer that sinks, such as the sink 14, always be capable of operation, for sanitation reasons. Also, in order to further reduce waste, the valves 28 for the water lines 22 and 24 are only open for a set period. This applies also to the valve 28 of each flush line 18.

The indicator lights 34 on the control panel 32 are used to notify responsible officials that excessive usage of a fixture F is being attempted. In other words, if an inmate is attempting to repeatedly operate the valve 28 of the toilet 12, then this fact is made known so that corrective action can be taken. An indicator light may also be provided to notify that a water line 22 or 24 is continually being operated. For this reason, the control panel 32 can be positioned in a guard's room or the like, or some other area which is continuously monitored. The panel 32 and the valves 28 do not occupy much space, and the panel 32 can, if necessary, be remote from the valves 28.

The control panel 32 furthermore has a master switch 54 which is used to prevent operation of all valves 28. The switch 54 is used, for example, when the corrections officers are about to conduct a search for contraband, and thereby wish to prevent operation of all valves 28 feeding the sinks 14 and toilets 12. This prevents contraband from being washed down the sinks 14 and/or flushed down the toilets 12.

The control panel 32 furthermore has switches 56 which are used to disable the valves 28 feeding an associated one of the cells C. In this way, the corrections officers can conduct a search for contraband in any one of the cells C, while permitting the remaining cell C to continue to be capable of consuming water.

While this invention has been described has having a preferred design, it is understood that it is capable of further modifications, uses and/or adaptations of the invention, following in general the principle of the invention, and including such departures therefrom as are customary in the art to which the invention pertains, and as may apply to the claims which are appended hereto.

What I claim is:

1. A control system for a prison plumbing system, comprising:

a) a plurality of water dispensing fixtures, each of said fixtures including a toilet and a sink for a faucet integral with one another;

b) a source of water;

c) a first plurality of flow regulating means, each of said plurality of flow regulating means including a flow valve interposed between one of said fixtures and said corresponding source for controlling water flow therebetween;

d) a first plurality of sensors, each of said sensors positioned proximate a corresponding one of said fixtures and actuable to request flushing of the corresponding fixture; and e) microprocessor-based control means operably associated with each of said flow regulating means and said sensors for automatically causing operation of a selected flow regulating means flow valve upon the expiration of a predetermined time period subsequent to actuation of the sensor associated with said selected flow regulating means, wherein said control means is located in a room remote from rooms in which said fixtures are located, and wherein said predetermined time period is of sufficient length so as to help prevent inmates from flushing sheets or the like down said toilets.

2. The system of claim 1, wherein:

a) said flow regulating means are remote from the associated fixtures.

3. The system of claim 1, wherein:

a) means are operably associated with said control means for preventing excessive operation of any one of said fixtures per unit time.

4. The system of claim 1, wherein:

a) means are operably associated with said control means for preventing operation of said flow regulating means even when said requesting means are requesting operation of the associated fixtures.

5. A method of controlling operation of prison fixtures, the method comprising the steps of:

a) an inmate signaling via a sensor to a controller a request for flushing of a prison fixture, wherein said sensor is hand-actuated and is located on a sink that is integral with the prison fixture;

b) said controller delaying operation of the prison fixture for a predetermined time period upon receipt of the signal from the sensor; and c) automatically permitting the fixture to flush after the predetermined time period has expired.

6. Flushing control system, comprising:

a) a prison fixture including a toilet and a sink;

b) a source of water;

c) regulating means, including a valve, interposed between said prison fixture and said source for regulating water flow to said prison fixture;

d) hand-actuated requesting means operably associated with said prison fixture for requesting operation of said regulating means; and e) control means operably associated with said requesting means and with said regulating means for preventing operation of said regulating means for a selected time period after said requesting means has been operated and for thereafter automatically permitting said regulating means to operate.

7. The system of claim 6, wherein:

a) said requesting means is manually operable.

8. A control system for a water distribution system in a prison having a prison fixture, a source of water, regulating valve means interposed between the prison fixture and the water source for controlling water flow therebetween, and inmate-actuated requesting means including a hand-actuated sensor operably associated with the regulating valve means for controlling operation thereof, the system comprising:

a) microprocessor-based control means, operably associated with the requesting means and the regulating valve means, for controlling operation of the regulating valve means, and said control means further for preventing operation of the regulating valve means for a selected time period after the sensor of the requesting means has been operated and for thereafter automatically causing the regulating valve means to open and close, wherein said control means includes a control panel located in a room remote from another room within which said fixture is located, and wherein said fixture includes a sink, a toilet, and said requesting means, all integral with one another.

9. Flushing control system for prisons, comprising:

a) a prison fixture including a toilet, a sink, and a hand-actuated sensor integral with one another as a unit fixture;

b) a source of water;

c) regulating means, interposed between said prison fixture and said source, for regulating water flow to said prison fixture;

d) requesting means including said hand-actuated sensor operably associated with said prison fixture for enabling a user to request operation of said regulating means; and e) control means operably associated with said requesting means and said regulating means for causing operation of said regulating means to be delayed for a predetermined time period after said requesting means has been operated by the user and to thereafter automatically cause said regulating means to operate so as to flush said toilet, said sensor being located proximate said sink at an elevation sufficient to enable hand-actuation, and said time period being of sufficient length so as to help prevent prisoners from flushing contraband down said toilet.

10. The system of claim 9, wherein:

a) said requesting means includes a sensor.

11. The system of claim 10, wherein:

a) said sensor is a contact sensor.

12. The system of claim 10, wherein:

a) said sensor is adjacent said fixture.

13. The system of claim 12, wherein:

a) said sensor is integral with said fixture.

14. The system of claim 9, wherein:

a) said regulating means is an electrically operated solenoid value.

15. The system of claim 14, wherein:

a) said solenoid valve and said control means are remote from said fixture.

16. The system of claim 13, wherein:

a) said sensor includes a contact portion and at least first and second electrical leads, said contact portion is associated with a first side of said fixture and said leads extend from a an opposite second side thereof.

17. The system of claim 16, wherein:

a) said fixture includes means isolating said leads from said contact portion.

18. The system of claim 9, wherein:

a) said control means includes means for adjusting said selected period.

19. The system of claim 9, wherein:

a) said fixture includes a toilet.

20. The system of claim 19, further comprising:

a) a second fixture proximate said toilet;

b) second means interposed between said source and said second fixture for regulating water flow thereto; and, c) second means operably associated with said second fixture and with said control means for requesting operation of said second regulating means.

21. The system of claim 20, wherein:

a) said requesting means is manually operable.

22. The system of claim 20, wherein:

a) said source of water includes a hot water supply and a cold water supply;

b) said first and second regulating means are operably associated with said cold water supply;

c) third means are interposed between said hot water supply and said second fixture for regulating hot water flow thereto; and, d) third means are operably associated with said second fixture and said control means for requesting operation of said third regulating means.

23. The system of claim 22, wherein:

a) said third requesting means is manually operable.

24. The system of claim 22, wherein:

a) said second and third regulating means are each an electrically operated solenoid valve.

25. The system of claim 22, wherein:

a) said first, second, and third requesting means are each a contact sensor, and each sensor is disposed adjacent the associated fixture.

26. The system of claim 22, wherein:

a) said second fixture is a sink.

27. The system of claim 9, wherein:

a) means are operably associated with said control means for preventing operation of said regulating means even when said requesting means is operated.

28. The system of claim 22, wherein:

a) said first, second, and third regulating means are remote from the associated fixtures.

29. The control system of claim 1, wherein said sensors are capacitance sensors that are hand-actuated.

30. The control system of claim 1, wherein control means further includes means for preventing a plurality of said toilets from being flushed at the same time.

31. A prison plumbing system comprising:

first, second, and third prison fixtures, said first, second, and third prison fixtures being located in first, second, and third rooms, respectively, and each of said prison fixtures including a toilet, a sink, and a hand-actuated sensor integral in a single fixture unit, and wherein said sensors are located at an elevation above corresponding toilets and sinks so as to enable inmates to actuate said sensors with their hands when it is desired to flush said toilet;

a normally closed flow regulating valve provided for each of said fixtures, each of said flow regulating valves being located in a fourth room remote from said first, second, and third rooms, and also remote from said fixtures, and said valves being interposed between a corresponding one of said fixtures and a water source so as to control water flow therebetween;

control means operatively associated with each of said flow valves and with each of said sensors, said control means being microprocessor-based and for causing a predetermined time delay to expire upon receipt of a flush signal from any one of said sensors and thereafter, enabling the corresponding toilet to flush, said time delay being of sufficient length so as to help prevent inmates from flushing contraband down said toilets;

solenoid valve operators, and a control panel, each operatively associated with said control means, and wherein said control panel, said valve operators, and said control means are all located in said fourth room; and wherein said sensors, when actuated, include means for permitting the flow of alternating current to said control panel.

32. The system of claim 31, wherein said control panel includes a plurality of indicator lights including means for indicating to responsible officials that excessive usage of a particular fixture(s) is being attempted, and wherein said panel includes a master switch (54) for preventing operation of all flow valves so as to prevent contraband for being flushed down the toilets prior to searches or the like.

* * * * *